US007150763B2

(12) United States Patent
Chen

(10) Patent No.: US 7,150,763 B2
(45) Date of Patent: Dec. 19, 2006

(54) METHOD OF MAKING FISH SKIN LEATHER

(76) Inventor: Hann-Kuang Chen, 7F, No. 90, Chien-Kuo 1st Rd., Lin-Ya Dist., Kaohsiung City (TW)

( * ) Notice: Subject to any disclaimer, the term of this patent is extended or adjusted under 35 U.S.C. 154(b) by 79 days.

(21) Appl. No.: 10/954,592

(22) Filed: Sep. 29, 2004

(65) Prior Publication Data

US 2005/0210597 A1 Sep. 29, 2005

(30) Foreign Application Priority Data

Mar. 29, 2004 (TW) ..... 93108516 A

(51) Int. Cl.
*C14C 3/00* (2006.01)

(52) U.S. Cl. ..... 8/94.12

(58) Field of Classification Search ..... 8/94.12
See application file for complete search history.

(56) References Cited

OTHER PUBLICATIONS http://fishskins.haslinger-knives.com/ copyright 1999-2005.*

* cited by examiner

*Primary Examiner*—Lorna M. Douyon
*Assistant Examiner*—Amina Khan
(74) *Attorney, Agent, or Firm*—Ladas & Parry LLP

(57) ABSTRACT

In a method of making fish skin leather, a fish skin with fish scales thereon is washed, cleaned, and tanned. Then, the fish scales are removed from the tanned fish skin to expose a plurality of ridges underlying the fish scales and presenting fish skin grains. The resultant fish skin leather has a skin substrate having a surface with fish skin grains that include a plurality of ridges which project from the surface of the skin substrate.

7 Claims, 4 Drawing Sheets

METHOD OF MAKING FISH SKIN LEATHER

CROSS-REFERENCE TO RELATED APPLICATION

This application claims priority of Taiwanese Application No. 93108516, filed on Mar. 29, 2004.

BACKGROUND OF THE INVENTION

1. Field of the Invention

The invention relates to a fish skin leather and a method of making the same, more particularly to a fish skin leather with vivid fish skin grains and a method of making the same.

2. Description of the Related Art

Raw materials for making leather goods generally include cattlehides and sheepskins. In addition, crocodile skins or scales are also used for making leather goods. Although crocodile skin leather goods have good reception, since crocodile skins are not easy to obtain and are relatively costly to process and manufacture, their share of the leather market is still limited. Hence, some manufacturers have switched to using fish skins for making leather since fish skins are readily available.

Conventional fish skin processing methods generally include tanning, dyeing, drying, glazing, etc. During the tanning process, the fish skin is washed and cleaned. Minute hair and scales attached to the surface of the fish skin are removed using specific agents. Then, active enzymes are used to disintegrate the flesh (including the outer surface of the fish skin which has fish skin grains and which has scales adhered thereto). The descaled fish skin obtained after the tanning process is substantially flat and smooth.

The descaled fish skin is then dyed with a predetermined color. The dyed skin is subsequently dried, ironed and glazed using organic agents such as lacquers to yield a sheet of fish skin leather.

As the method for processing fish skins is very similar to that for processing cattlehides and sheepskins, and as fishes are comparatively small in size and can be bred on an intensive scale, fish skins are promising raw materials for making leather on a large scale. However, fish skin leathers available on the market are largely flat. In other words, while fish skin leathers are smooth to the touch, they lack vivid fish skin grains that are marked by distinct ridges and furrows, and hence fail to provide a rich texture. As such, the varieties of fish skin leathers available for consumer selection are limited.

SUMMARY OF THE INVENTION

Therefore, an object of the present invention is to provide a fish skin leather having vivid fish skin grains, and a method of making the same.

According to one aspect of the invention, a method of making fish skin leather includes: (a) washing, cleaning and tanning a fish skin with fish scales intact thereon; and (b) removing the fish scales from the tanned fish skin to expose a plurality of ridges underlying the fish scales and presenting fish skin grains.

According to another aspect of the invention, a fish skin leather includes a skin substrate having a surface with fish skin grains that include a plurality of ridges which project from the surface.

According to a further aspect of this invention, a method of making fish skin leather includes: (a) tanning a fish skin; and (b) providing the tanned fish skin with a primary color and a secondary color, wherein the secondary color is provided on raised ridges which project from a surface of the fish skin to present fish skin grains, and the primary color is provided on the surface of the fish skin other than the raised ridges.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
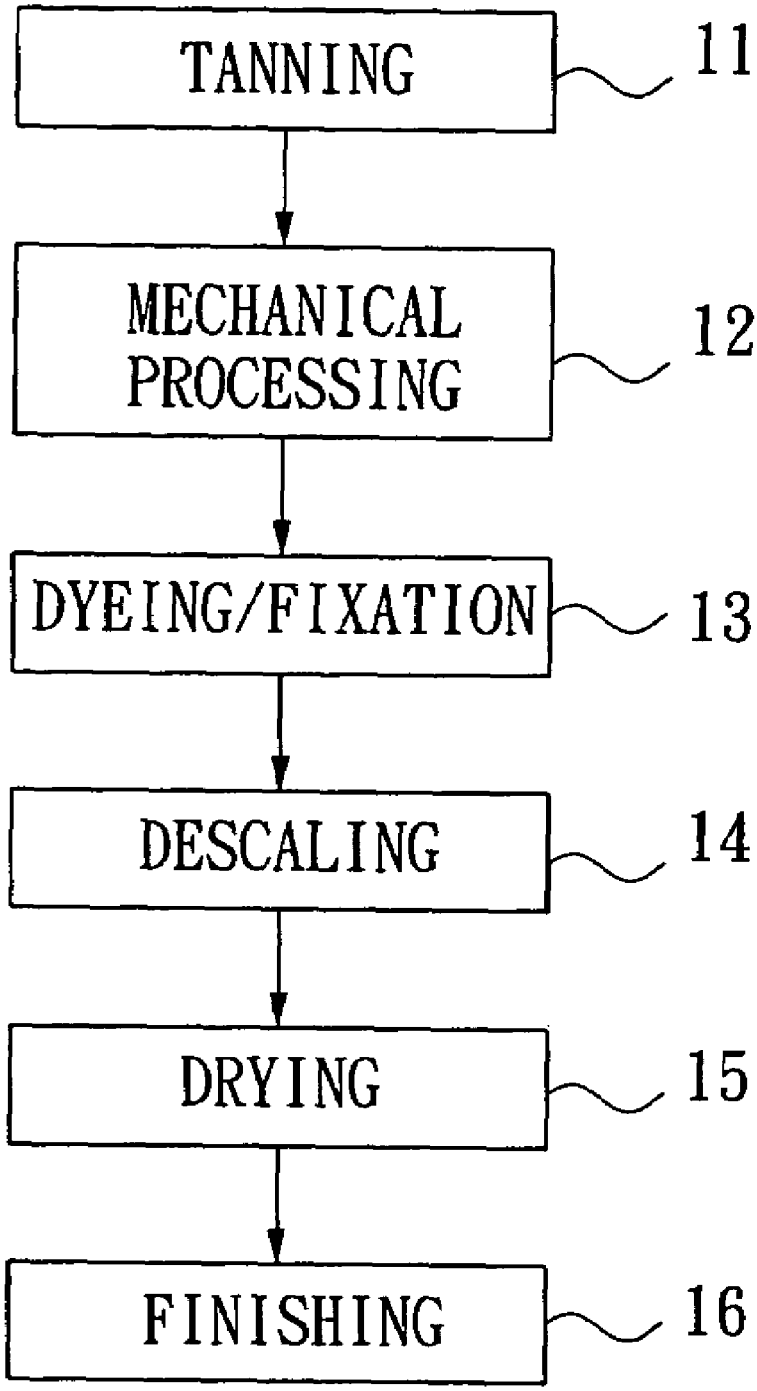
FIG. 1 is a flowchart illustrating the first preferred embodiment of a method of making a fish skin leather according to this invention.

Referring to FIG. 1, the first preferred embodiment of a method of making a fish skin leather having vivid fish skin grains according to the this invention is shown to include steps 11 to step 16. The fish skin leather is prepared from a fish skin having a skin substrate 22 and scales 21 covering the skin substrate 22. Initially, in step 11, the fish skin with the scales 21 intact thereon is washed in running water to which bactericides are added so as to remove any dirt thereon (including blood and flesh attached to the skin substrate 22), followed by treatments using alkali and proteinase to disintegrate keratin and any flesh remaining on the fish skin, and chrome-tanning using a chromium salt.

Figure 2:
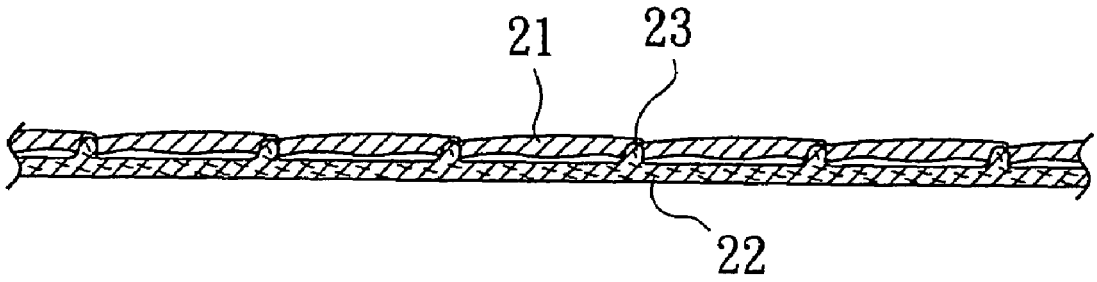
FIG. 2 is a fragmentary schematic sectional view of a fish skin with scales employed in the first preferred embodiment.

At this stage, the tanned fish skin resulting from step 11 still has the scales 21 intact thereon (see FIG. 2). As such, ridges 23 (connective tissues of the dermis of the fish skin from which the scales 21 emerge and to which the scales 21 adhere) which present fish skin grains are shielded by the respective scales 21 and are therefore protected from the enzymic action of the proteinase and the chemical action of the chromium salt.

Next, mechanical processing is carried out in step 12 to trim and stretch the fish skin. Subsequently, in step 13, the fish skin is subjected to dyeing and fixation. The fish skin is dyed using a primary coloring agent, and the dye is then fixed using a grease. In this step, although the scales 21 are still on the skin substrate 22, they do not adhere to the skin substrate 22 as tightly as before. In other words, there are clearances between the scales 21 and the surface of the skin substrate 22, and the scales 21 cover loosely the skin substrate 22. As such, the primary coloring agent can penetrate into the skin substrate 22 through the sides of the scales 21.

Thereafter, in step 14, the scales 21 are removed from the fish skin through a mechanical treatment, such as agitating the fish skin in a revolving drum to friction the fish skin, thereby exposing the ridges 23 that were protected by the scales 21 and that will form the fish skin grains on a finished product of the present invention.

The descaled fish skin is then removed from the drum and is subjected to a drying treatment in step 15. As the drying treatment is well known in the art, it will not be described in detail herein for the sake of brevity. Then, a steel brush is used to buff the surface of the descaled fish skin with the fish skin grains such that top surfaces of the ridges 23 provide a relatively flat and smooth tactility, and such that there is a contrast between the color of the ridges 23 and the color of the remaining parts of the fish skin to render the overall fish skin grains of the fish skin more vivid in appearance.

Figure 3:
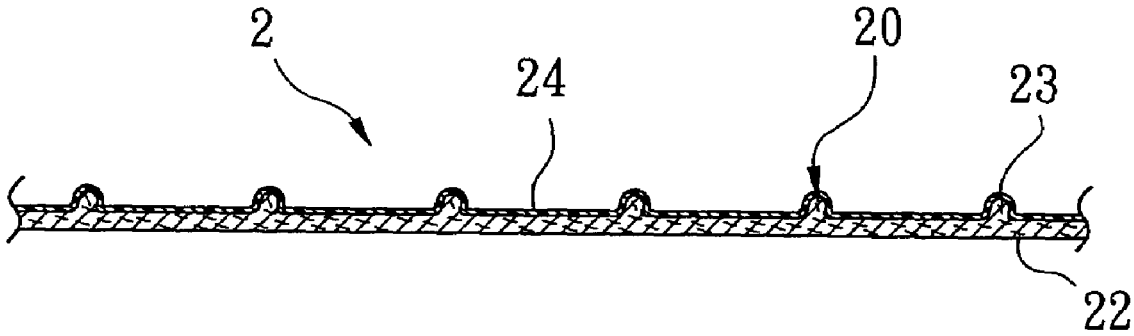
FIG. 3 is a fragmentary schematic sectional view of the fish skin with the scales removed therefrom.

The last step 16 is a finishing step, in which the fish skin is coated with a glaze 24 (see FIG. 3), heated, and ironed so as to develop gloss on the fish skin, thereby resulting in a fish skin leather 2 with glossy and vivid fish skin grains. As shown in FIG. 3, the fish skin leather 2 thus obtained includes a skin substrate 22 with fish skin grains 20, and is covered with the glaze 24. The fish skin grains 20 are constituted by a plurality of the ridges 23, which project from a surface of the skin substrate 22.

In the present invention, removal of the scales 21 from the fish skin is conducted after dyeing/fixation in step 13 such that the ridges 23 are protected by the scales 21 from the chemical action of the proteinase and other agents during cleaning and tanning, thereby preserving substantially the integrity of the ridges 23 throughout the manufacturing process. As the ridges 23 project from the surface of the skin substrate 22, they provide the fish skin leather 2 with a characteristic uneven texture that is distinctly different from the flat and smooth texture of conventional fish skins.

Figure 4:
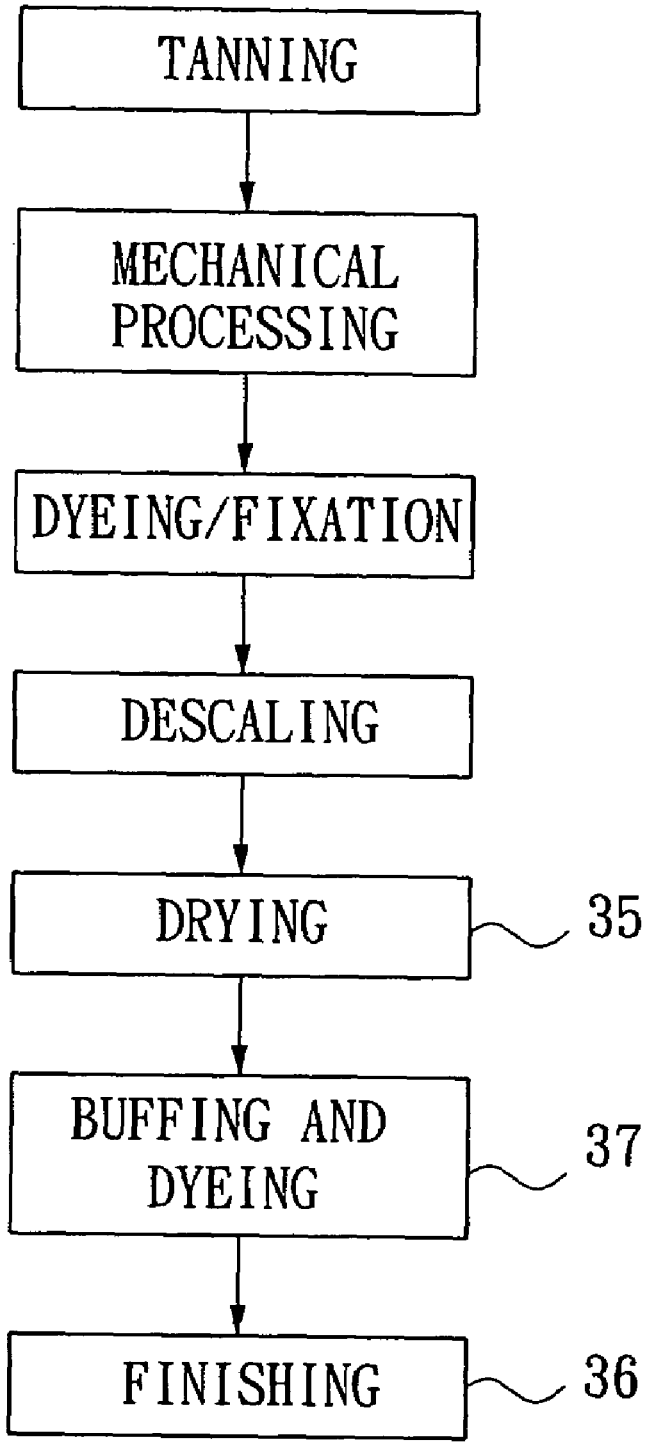
FIG. 4 is a flowchart illustrating the second preferred embodiment of a method of making a fish skin leather according to this invention.
Figure 5:
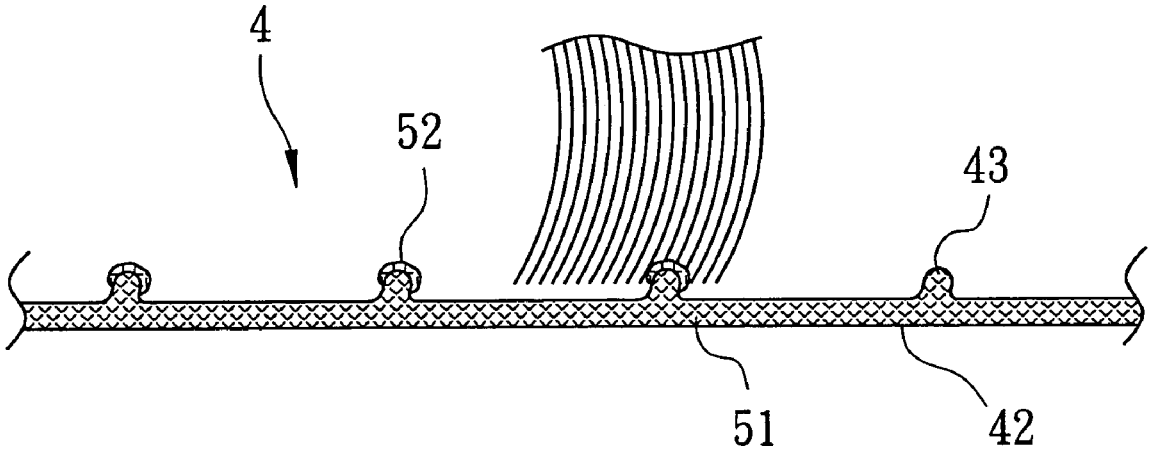
FIG. 5 is a fragmentary schematic sectional view showing how ridges projecting from the surface of a descaled fish skin are dyed using a brush.

Referring to FIG. 4, the second preferred embodiment of a method of making a fish skin according to this invention is substantially similar to the previous embodiment. The difference resides in that, prior to the finishing step 36, a step 37 is performed to buff the descaled fish skin, followed by a secondary dyeing treatment. That is, after the drying step in step 35, the descaled fish skin has to be mechanically buffed such that top surfaces of the ridges 43 on the fish skin are relatively smooth. Thereafter, the ridges 43 are dyed with a secondary coloring agent 52 using a brush, as best shown in FIG. 5. The secondary coloring agent 52 has a color different from that of the primary coloring agent 51 applied to the skin substrate 42.

Because the ridges 43 project from the skin substrate 42, only the ridges 43 will be dyed with the secondary coloring agent 52 during the secondary dyeing treatment in step 37. Thus, there is an enhanced color contrast between the ridges 43 and the rest of the fish skin, thereby lending a stereoscopic (three-dimensional) effect to the resultant fish skin leather 4.

In an alternative embodiment, the secondary dyeing treatment is performed immediately after the drying step 35, and the ridges 43 are thereafter buffed such that the ridges 43 have a unique tone of color that contrasts with the color of the rest of the fish skin. Thus, the resultant fish skin leather 4 exhibits a layered effect with rich color variations.

From the foregoing, it can be appreciated that, by removing the scales 21 from the fish skin after chemically cleaning, tanning and dyeing the fish skin, the fish skin leather 2, 4 produced according to the method of this invention can have vivid fish skin grains with contrasting colors and a layered effect.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A method of making fish skin leather, comprising:

(a) washing, cleaning and tanning a fish skin with fish scales intact thereon; and (b) removing the fish scales from the tanned fish skin to expose a plurality of ridges underlying the fish scales and presenting fish skin grains.

2. The method as claimed in claim 1, further comprising the step of dyeing the tanned fish skin with a primary color while the fish scales are still intact on the tanned fish skin after step (a) and before step (b).

3. The method as claimed in claim 1, further comprising the step of drying, ironing and glazing the fish skin from which the fish scales have been removed to develop gloss on the fish skin after step (b).

4. The method as claimed in claim 1, further comprising the step of buffing the fish skin after step (b).

5. The method as claimed in claim 2, further comprising the step of dyeing the ridges with a secondary color which is different from the primary color.

6. The method as claimed in claim 1, wherein the fish scales are removed from the fish skin through a mechanical treatment in a drum.

7. A method of making fish skin leather, comprising:

(a) tanning a fish skin; and (b) providing the tanned fish skin with a primary color and a secondary color, wherein the secondary color is provided on raised ridges which project from a surface of the fish skin to present fish skin grains, and the primary color is provided on the surface of the fish skin other than the raised ridges;

wherein the fish skin is tanned with fish scales intact on the fish skin, and the primary color is provided on the surface of the fish skin by dyeing the fish skin with the fish scales intact thereon;

wherein the secondary color is provided on the surface of the fish skin after the fish scales are removed from the fish skin.

* * * * *